US012024988B2

(12) United States Patent
Wildman, Sr. et al.

(10) Patent No.: US 12,024,988 B2
(45) Date of Patent: Jul. 2, 2024

(54) GAS LIFT SYSTEM AND METHOD

(71) Applicant: Sam and Gail LLC, Kingwood, TX (US)

(72) Inventors: Samuel Levern Wildman, Sr., Kingwood, TX (US); William Durell Wildman, Cincinnati, OH (US); Maxwell Ryan Wildman, Kingwood, TX (US)

(73) Assignee: Sam and Gail LLC, Kingwood, TX (US)

( * ) Notice: Subject to any disclaimer, the term of this patent is extended or adjusted under 35 U.S.C. 154(b) by 138 days.

(21) Appl. No.: 17/707,064

(22) Filed: Mar. 29, 2022

(65) Prior Publication Data

US 2022/0307353 A1 Sep. 29, 2022

Related U.S. Application Data

(60) Provisional application No. 63/167,297, filed on Mar. 29, 2021.

(51) Int. Cl.
*E21B 43/12* (2006.01)
*E21B 34/10* (2006.01)

(52) U.S. Cl.
CPC ..... *E21B 43/123* (2013.01); *E21B 34/10* (2013.01)

(58) Field of Classification Search
CPC ..... E21B 43/122; E21B 43/123; E21B 34/10; E21B 43/121; E21B 43/13; E21B 43/1235
See application file for complete search history.

(56) References Cited

U.S. PATENT DOCUMENTS 2,725,014 A * 11/1955 Pryor ..... E21B 43/123 137/155
3,224,459 A * 12/1965 Lilly ..... E21B 43/123 137/155
4,682,656 A 7/1987 Waters
5,022,427 A 6/1991 Churchman
(Continued)

FOREIGN PATENT DOCUMENTS

WO WO 00/79098 A1 12/2000

OTHER PUBLICATIONS

International Search Report and Written Opinion received in related PCT/US2022/022274 dated Aug. 3, 2022 (pp. 14).

*Primary Examiner* — Nicole Coy
*Assistant Examiner* — Yanick A Akaragwe
(74) *Attorney, Agent, or Firm* — Woodard, Emhardt, Henry, Reeves & Wagner, LLP

(57) ABSTRACT

A gas lift system for lifting oil with a production tube positioned inside a well casing with manifolds in the production tube spaced apart from each other; the system including valve assemblies on the manifolds that each have an open position and a closed position, each of the valve assemblies including a biasing device that biases the valve towards the closed position, where pressurizing each valve assembly with a control fluid generates a force that acts against the biasing force of the biasing device to open the valve, and a means to selectively control the pressure of the control fluid in the control line, where each of the valve assemblies includes different biasing forces in each valve, with a topmost valve having a highest biasing force and each sequentially lower valve having a lower biasing force. A method for using the gas lift system is also included.

21 Claims, 10 Drawing Sheets

(56) References Cited

U.S. PATENT DOCUMENTS

| | | | | |
|---|---|---|---|---|
| 5,066,198 | A | 11/1991 | Decker | |
| RE36,566 | E | 2/2000 | Pringle | |
| 6,148,843 | A | 11/2000 | Pringle | |
| 9,611,720 | B2 | 4/2017 | Sevheim | |
| 9,638,001 | B2 | 5/2017 | Veeken | |
| 11,613,973 | B1 | 3/2023 | Turk | |
| 2007/0276542 | A1 | 11/2007 | Coward | |
| 2011/0083855 | A1 | 4/2011 | Wygnanski | |
| 2020/0032627 | A1 | 1/2020 | Salihbegovic et al. | |
| 2021/0172300 | A1* | 6/2021 | Rodger | E21B 34/066 |
| 2021/0189850 | A1* | 6/2021 | Anderson | E21B 34/10 |

* cited by examiner

GAS LIFT SYSTEM AND METHOD

CROSS-REFERENCE TO RELATED APPLICATIONS

This application claims the benefit of U.S. Provisional Application No. 63/167,297 filed Mar. 29, 2021, which is hereby incorporated by reference.

BACKGROUND

The present disclosure pertains generally to a valve and valve control system used in the oil and gas industry for a type of artificial lift known as Gas Lift. The valve system is also usable with a secondary recovery method known as Waterflood.

Gas Lift is used when a well's reservoir pressure is insufficient to overcome hydrostatic pressure to produce the flow of production fluid (such as crude oil) to the surface. Gas lift may be used to reduce the hydrostatic pressure of a column of production fluid relative to a well's reservoir pressure to flow production fluid to the surface. Gas Lift generally involves injecting a gas, such as Compressed Natural Gas (CNG) into the column of production fluid. The addition of gas bubbles in the production fluid reduces the density of the production fluid in the column, thereby reducing the hydrostatic pressure of the column of fluid.

A typical production well where gas lift is used includes an outer well casing and a production tube positioned within the outer well casing. The production tube is a string of tubes that generally includes several manifolds spaced apart along the length of the production tube, with a gas lift valve located at each manifold to selectively control fluid flow between the production tube and the annulus between the outer well casing and the production tube.

Before starting Gas Lift, both the production tube and the annulus in the outer well casing are typically filled with production fluid. One of the issues in initiating Gas Lift is getting the CNG to the bottom of the well tubing so that the CNG bubbles through the entire hydrostatic column of production fluid. When starting, as gas is supplied into one of the production tube or annulus, the gas-liquid interface between the CNG and the production fluid is driven downward. When the gas reaches the first manifold, the gas lift valve in the first manifold is open or opened to bubble gas into the column of production fluid above the first manifold, lightening the production fluid above the first manifold and incrementally reducing the hydrostatic pressure of the entire column of fluid.

As the gas-liquid interface reaches the second manifold, the gas lift valve in the second manifold is open or opened to bubble gas into the column of production fluid above the second manifold. At this point, the valve in the first manifold should be closed to help force gas through the second manifold (otherwise excessive gas may flow through the first manifold, reducing the amount of gas flowing through the second manifold). The process of selectively opening and closing these valves is the subject of this Application.

There are several known prior art methods of operating Gas Lift systems. Since the mid-1940's, Dome Pressure Operated Bellows Valve, as described in U.S. Pat. No. 2,339,487, has dominated the market. For clarity, this type of valve is referred to in industry as an Injection Pressure Operated Valve (IPO).

The IPO valve has a dome, bellows, ball stem, and seat/port. The dome is attached to the bellows and the ball stem is attached to the other end of the bellows. Nitrogen is then applied to the dome which energizes the bellows forcing the ball stem onto the seat forming a tight seal as shown in FIG. 1. The nitrogen charge sets the pressure dome (Pd) of each valve.

During operation in the well, all the valves in the installation are in the open position when covered with fluid in the well due to the fluids hydrostatic pressure compressing the bellows and pulling the ball stem away from the seat.

To startup the well, the startup volume and pressure of the injected gas is controlled as per recommended standards until the anticipated start up gas pressure is reached. Control is necessary since as the injection gas pressure increases, the injected gas reduces the hydrostatic head of fluid being used to load or kill the well from the area chosen as the injection path down through the upper most valve in the string. A known problem of the IPO valve is that incorrect startup can result in fluid flow eroding the valves stems and seats.

During startup, once the fluid is displaced down to the upper most valve, a sufficient volume of gas is injected to maintain the valve in the open position while the fluid is also being displaced to the next lower valve in succession. When the next lower valve is reached, there are two valves open and able to pass injected gas. Since the volume of injected gas is controlled at the surface, the CNG injection pressure reduces, which results in the first in line valve closing. This is accomplished by setting the pressure dome (Pd) in each valve based on calculated conditions at depth, with the upper most valve's Pd being the greatest with the Pd being reduced at each lower valve in succession. For this to work when using the IPO valve, volume of injected gas is controlled to reduce the injection pressure at each lower valve in succession (to prevent the upper valves from opening).

IPO valves are a one direction valve, Upstream to Downstream, and generally requires a velocity reverse flow check valve to reduce or prevent backflow when downstream pressure exceeds upstream pressure.

Another commonly used prior art valve is the Production Pressure Operated valve (PPO), also known as a Fluid Valve. A generic PPO valve is shown in FIG. 2. PPO valves are generally controlled by the downstream pressure of the production fluid, with the production fluid acting to generate a force that counters a force such as provided by the coil spring charged bellows or the like. Once the valve cracks open, the valve's bellows is loaded by bringing the valve to critical flow through the lower part of the crossover seat and closes when the downstream pressure is reduced to the pre-determined downstream pressure (Pt). When configured properly, Pt is not reached until the next valve in succession is uncovered and gas is injected to lessen the density of the producing fluids.

PPO valves are a one direction valve, Upstream to Downstream, and generally requires a velocity reverse flow check valve to allow the bellows to sense the downstream pressure but go on seat and prevent backflow when downstream pressure exceeds upstream pressure sufficiently to create velocity great enough to flow the check dart on seat. PPO valves advantageously do not require reduction in injection gas pressure to close each lower valve in succession. However, PPO valves require precise production rate predictions for proper operation. In addition, there is the potential for injection gases to be retained in areas needing to sense producing pressures, which can result in the PPO valve not working as intended. Finally, PPO valves generally use a torturous flow path for the injected CNG that is less efficient than other valves.

Another type of prior art valve is a Differential Pressure Operated Valve. The basic concept is injecting gas under the maximum production pressure, at the deepest possible point, and with the smallest possible differential. This concept is accomplished automatically with the use of a professionally designed differential valve. The main reason for the efficiency that can be obtained with a differential valve is that the maximum injection pressure can be used. This means high pressure gas can be injected into the production string with minimal pressure loss or differential. This allows most gas expansion to occur in the production string providing maximum conversion of potential energy to work. In addition, many calculations needed with other valves are not required including dome pressure, pressure at depth and temperature.

Early types of differential valves were essentially spring-loaded pistons with one end of the piston exposed to casing pressure while the opposite end is exposed to tubing pressure. Casing pressure (injection pressure) enters the valve through restrictions in the side of the valve. This restriction is generally always smaller than the valve port so that tubing pressure is acting on the stem. A schematic of this type of differential valve can be seen in FIG. 3. FIG. 3 includes tubing 10, valve stem 12, adjusting nut 13, spring 14, choke 15, valve seat 16 and outlet passage 17. Differential valves are normally open and require a differential between casing and tubing pressures to close. This differential depends upon the spring force holding the valve open if the piston has equal areas at each end.

However, differential valves often have several problems. In use, differential valves tend to cycle between open and closed before assuming either position, which can cause wear on valve parts and erratic operation. In addition, since reopening pressure is essentially equal to closing pressure, it is possible during unloading a gas-lift installation for multiple valves to be open at the same time, which could result in stopping the unloading process without reaching the desired injection point. Also, when CNG injection rate exceeds a differential valve's choke capacity, CNG pressure increases which results in a corresponding increase in the reopen pressure of the valve.

The gas lift valve and method disclosed in this paper seek to address some of the known issues in operating gas lift systems.

DETAILED DESCRIPTION OF THE DRAWINGS

Figure 1:
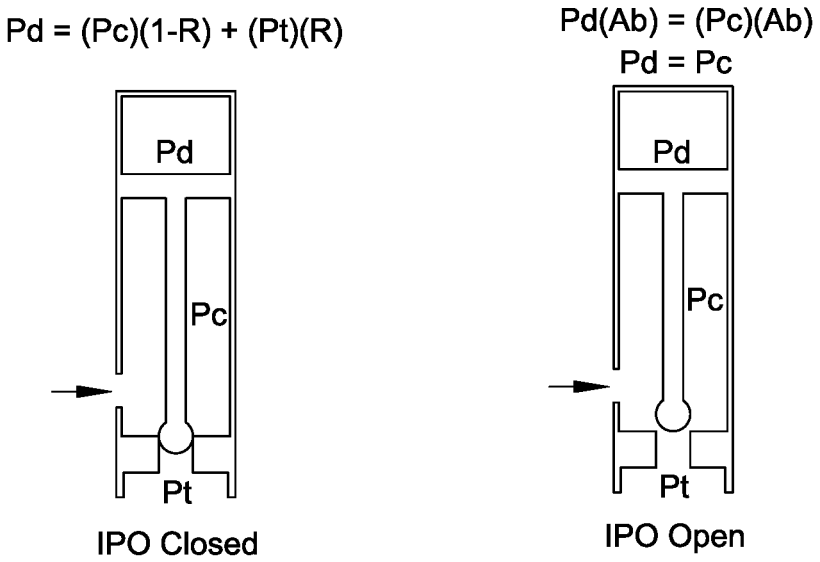
FIG. 1 (PRIOR ART)
FIG. 1 is a schematic diagram of a prior art IPO valve mechanism.
Figure 2:
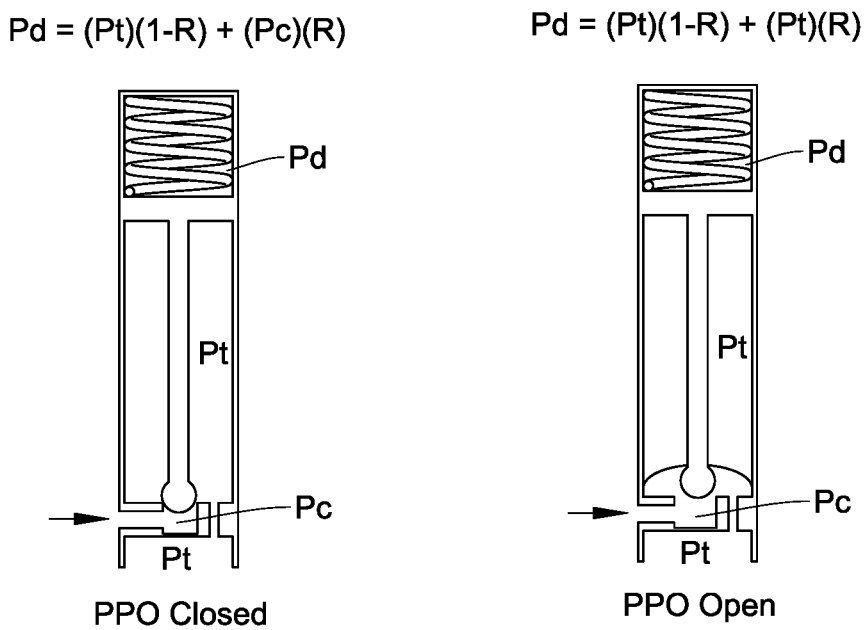
FIG. 2 (PRIOR ART)
FIG. 2 is a schematic diagram of a prior art PPO valve mechanism.

For the purpose of promoting an understanding of the principles of the claimed invention, reference will now be made to the embodiments illustrated in the drawings and specific language will be used to describe the same. It will nevertheless be understood that no limitation of the scope of the claimed invention is thereby intended. Any alterations and further modifications in the described embodiments, and any further applications of the principles of the claimed invention as described herein are contemplated as would normally occur to one skilled in the art to which the claimed invention relates. One embodiment of the claimed invention is shown in great detail, although it will be apparent to those skilled in the relevant art that some features that are not relevant to the present claimed invention may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "left", "right", "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

For purposes of the claims in this Application, Belleville washer refers to a frusto-conical shaped washer. Other common names used in industry for this kind of washer include coned-disc spring, conical spring washer, disc spring and cupped spring washer.

While this Application and claims refer to Compressed Natural Gas (CNG), the disclosed valve and system are not limited to use with CNG. CNG is commonly used in Gas Lift systems because it does not include any oxygen (which could create an explosive mixture with crude oil if bubbled through a column of crude oil). CNG is also commonly found in crude oil deposits and is easily extracted from the crude oil. References to CNG through the application and claims should not be understood as limiting, but only represents what Is currently common in industry. The disclosed valve and system could be used with any other gas used in gas lift.

Figure 4:
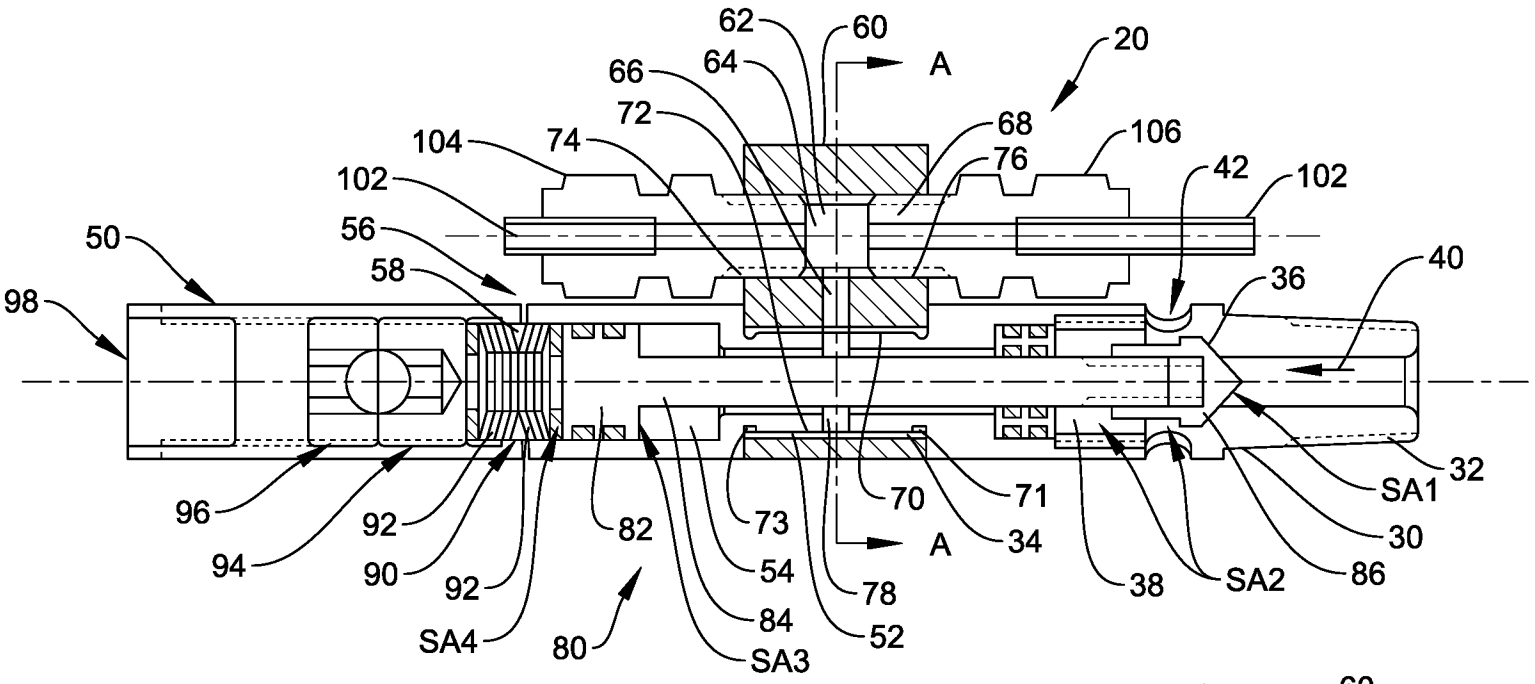
FIG. 4 is a cross-sectional view of a valve assembly.
Figure 5:
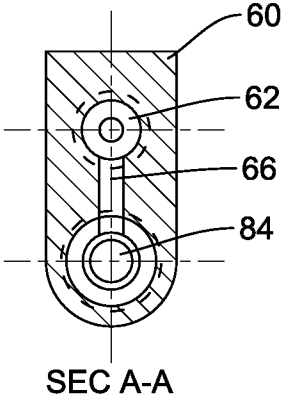
FIG. 5 is a cross-sectional view of the FIG. 4 valve assembly taken along line A-A.

Referring to FIGS. 4 and 5, valve assembly 20 is illustrated. Valve assembly 20 generally includes valve body 30, valve body 50, mounting body 60, valve assembly 80, and biasing assembly 90. Valve body 30 generally includes mounting portions 32 and 34 and valve seat 36. Valve body 30 also defines chamber 38 and ports 40 and 42. Valve body 50 generally includes mounting portion 52 and defines chambers 54 and 58 and port 56. Mounting body 60 defines chamber 62 that includes inlets 64 and 78 and outlets 66 and 68, coupling portions 70, 72, 74 and 76. Valve assembly 80 generally includes piston 82, stem 84 and valve member 86. Biasing assembly 90 generally includes biasing member 92, force adjusting member 94, force locking member 96 and end cap 98.

Valve assembly 20 is assembled with mounting portion 34 of valve body 30 removably coupled to coupling portion 70 of mounting body 60 with seal 71 positioned there between and mounting portion 52 of valve body 50 removably coupled to coupling portion 72 of mounting body 60 with seal 73 positioned there between. In the illustrated embodiment, valve bodies 30 and 50 are attached to mounting body 60 with male and female threads. The space between valve bodies 30 and 50 defines inlet 78.

Piston 82 is inserted into chamber 54 with stem 84 passing through inlet 78 into chamber 38 with piston 82 positioned between port 56 and mounting portion 52. Valve member 86 is removably coupled to stem 84 within chamber 38. In the illustrated embodiment, valve member 86 and stem 84 are attached by male and female threads. Valve member 86 defines external surface area SA1 and internal surface area SA2. Piston 82 defines internal surface area SA3 and external surface area SA4.

External surface area SA1 is the area that fluid in manifold port 40 bears against. Pressure on external surface area SA1 acts to push valve member 84 away from valve seat 36. Internal surface area SA2 is the area that control fluid in chamber 38 bears against. Pressure on internal surface area SA2 acts to push valve member 84 toward valve seat 36. Internal surface area SA3 is the area that fluid in chamber 54 bears against. Pressure on internal surface area SA3 acts to push valve member 84 away from valve seat 36. External surface area SA4 is the area the fluid in chamber 58 bears against. Pressure on external surface area SA4 acts to push valve member 84 toward valve seat 36. Forces acting to push valve member 84 toward valve seat 36 include force generated by biasing member 92, pressure on internal surface area SA2 and external surface area SA4. Forces acting to push valve member 84 away from valve seat 36 include pressure on external surface area SA1 and internal surface area SA3. These net forces dictate whether valve assembly 20 is open or closed. For purpose of these calculations, the specific areas used in these force calculations are the effective area extending perpendicular to the axis defined along stem 84.

Biasing assembly 90 is positioned so that piston 82 and port 56 are positioned between biasing assembly 90 and mounting portion 52 with port 56 providing a fluid path between an outside of valve body 50 and chamber 58. In the illustrated embodiment, a plurality of biasing members 92 are sandwiched between force adjusting member 94 and piston 82 with biasing members 92 roughly aligned inside of port 56 in chamber 58. Force locking member 96 selectively secures the relative position of force adjusting member 94. In the illustrated embodiment, force adjusting member 94 is threadingly engaged with valve body 50 and force locking member 96 is a lock nut that is also threadingly engaged with valve body 50 which can be selectively locked against force adjusting member 94. Force adjusting member 94 provides a means to adjust the biasing force of biasing member 92. End cap 98 optionally covers the open end of valve body 50. In the illustrated embodiment, end cap 98 is threadingly engaged with valve body 50.

Valve assembly 20 is coupled to a manifold with mounting portion 32. In the illustrated embodiment, mounting portion 32 is a male threaded end of valve body 30 that threads into female threads on a manifold. Other methods of fluidly connecting valve assembly 20 to a manifold can also be used. Mounting portion 32 provides a coupling means for connecting valve assembly 20 to a manifold.

FIGS. 4 and 5 also illustrates how valve assembly 20 may be coupled to control system 100. As shown in FIG. 4, control line 102 is coupled to mounting body 60 with couplers 104 and 106. Coupler 104 is coupled to mounting body at coupling portion 74 and coupler 106 is coupled to mounting body 60 at coupling portion 76. Valve body 30 and mounting portion 32 are rotatable relative to mounting body 60 and inlet coupling portion 74 due to the threaded connection between mounting portion 34 and coupling portion 70.

Figure 6:
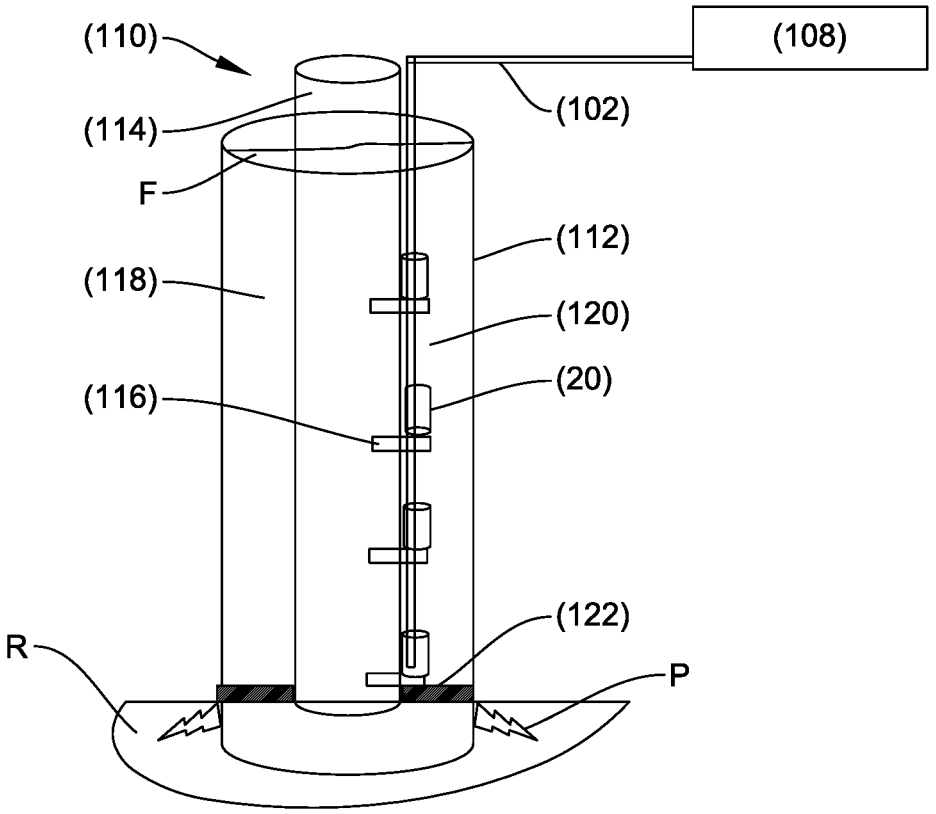
FIG. 6 is a schematic diagram of a production well configured with the FIG. 4 valve assembly configured in a tubing production arrangement in a startup condition.
Figure 7:
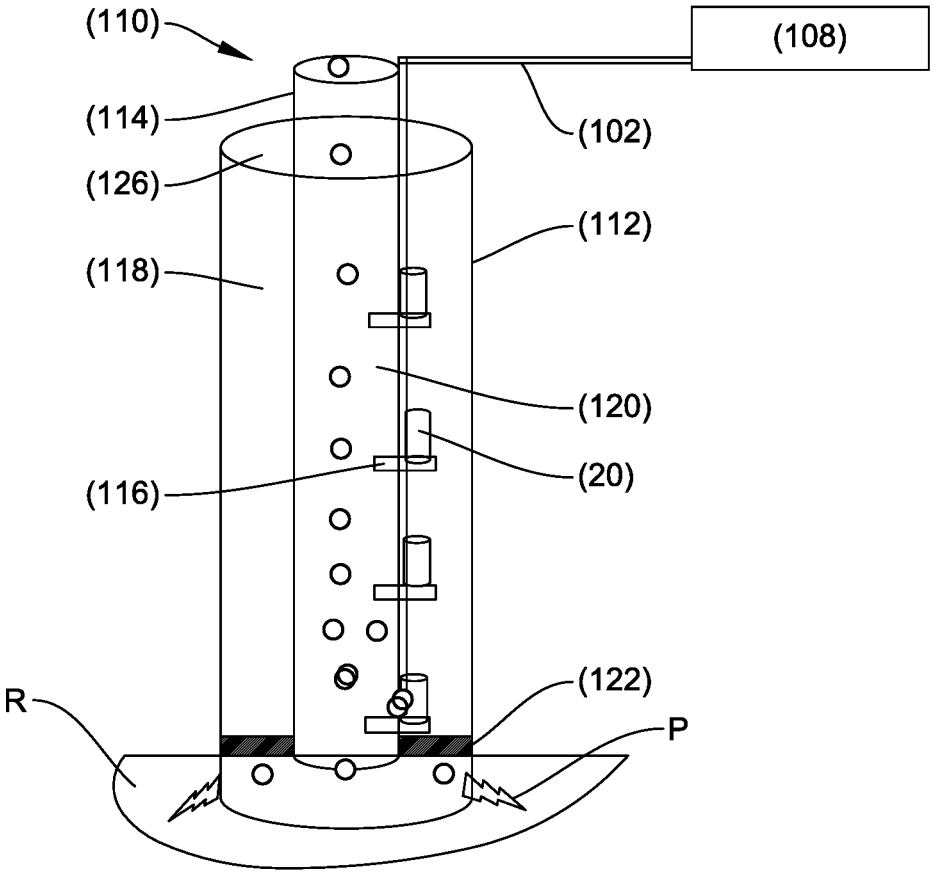
FIG. 7 is a schematic diagram of the FIG. 6 production well configuration in a production condition.
Figure 8:
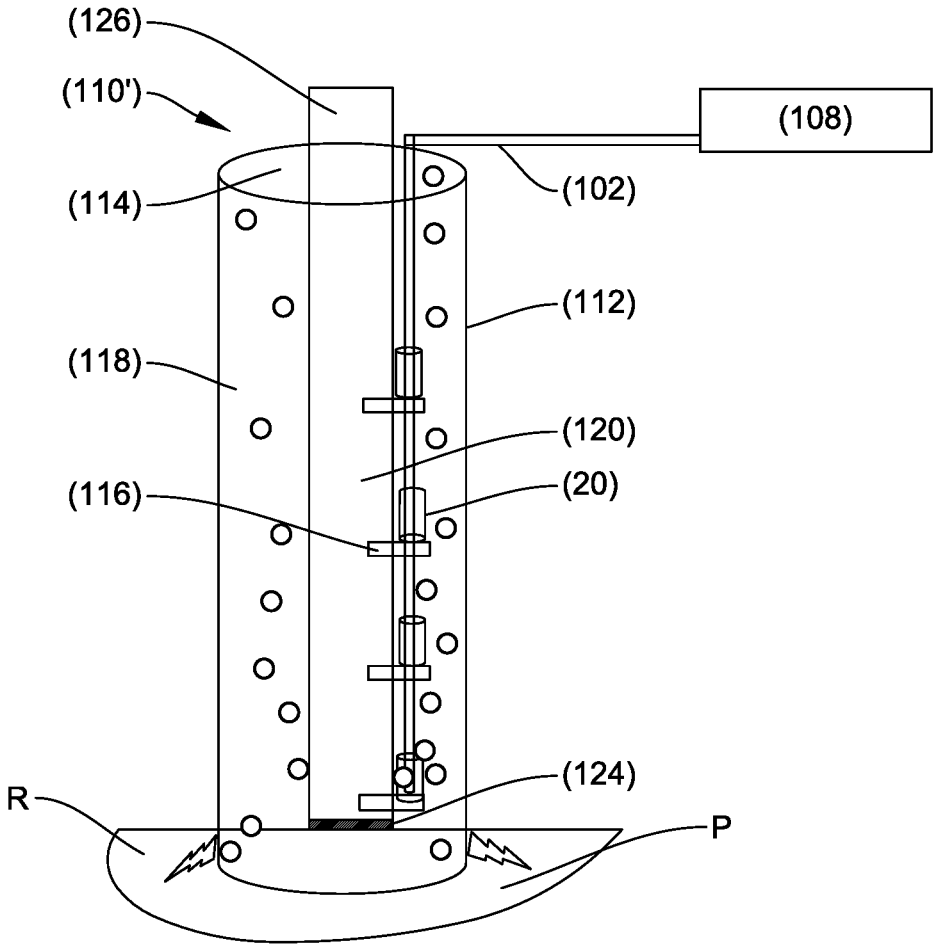
FIG. 8 is a schematic diagram of a production well configured with the FIG. 4 valve assembly configured in an annulus production arrangement in a production condition.

Referring now to FIGS. 6-8, two production well 110 configurations are shown utilizing valve assembly 20. FIGS. 6-7 illustrate production well 110 configured for production through the inner tube while FIG. 8 illustrates production well 110' configured for production through the annulus. In general, both production well 110 and production well 110' include outer well casing 112, production tube 114, one or more manifolds 116 and either packer 112 or plug 124. Production well 110 defines annulus path 118 positioned in the annular space between outer well casing 112 and production tube 114 and tube path 120 positioned inside of production tube 114. Manifolds 116 define an opening in production tube 114 that defines a fluid path between annulus path 118 and tube path 120. Valve assemblies 120 are coupled to manifolds 116 to selectively open or close the fluid path between annulus path 118 and tube path 120. Production well 110 provides a path from the surface to reservoir R. Reservoir R may include perforations P that may facilitate flow of fluids to production well 110. Generally, reservoir R includes hydrocarbons such as crude oil, although production well 110 could be used to assist extracting other types of fluid.

FIGS. 6-8 also illustrate control system 100 that includes control line 102 and controller 108. Control line 102 fluidly couples each valve assembly 20 to controller 108. Controller 108 provides pressurized fluid through control line 102 to each valve assembly 20. Each valve assembly 20 is exposed to the same pressurized fluid from controller 108 (with head pressures in control line 102 providing incrementally greater pressure to lower valve assemblies 20). Controller 108 provides a means to selectively control the pressure of a control fluid in control line 102.

Production well 110 shown in FIGS. 6 and 7 includes packer 122 which seals the bottom of annulus path 118 so that CNG can be injected into annulus path 118 and not enter reservoir R. Production well 110 includes sensor 126 positioned near the top of annulus path 118 operable to determine the injected pressure of CNG. Production well 110' shown in FIG. 8 includes plug 124 that seals the bottom of tube path 120 so that CNG can be injected into tube path 120 and not enter reservoir R. Production well 110' includes sensor 126 positioned near the top of tube path 120 to determine the injected pressure of CNG. Both packer 122 and plug 124 serve to force injected CNG into the other of the annulus path 118 or tube path 120 to facilitate gas lift to assist in the extraction of fluid from reservoir R.

FIG. 6 illustrates a startup condition before application of CNG to annulus path 118. Fluid level F is at the top of both annulus path 118 and tube path 120. FIG. 7 illustrates a production condition with CNG filling the entirety of annulus path 118 and passing through the lowest valve assembly 20 to provide gas lift to the entire column of production fluid in tube path 120. FIG. 8 illustrates a production condition with CNG filling the entirety of tube path 120 and passing through the lowest valve assembly 20 to provide gas lift to the entire column of production fluid in annulus path 118. Generally, the cross sectional areas of annulus path 118 and tube path 120 are different, so production capacity can be maximized in different conditions by selecting one of annulus path 118 or tube path 120 to provide an optimal production path for a particular production well.

Valve assemblies 20 are coupled to manifolds 116 with valve bodies 30 and 50 positioned inside annulus path 118. Manifold port 40 is exposed to tube path 120 through manifold 116. Annular port 42 is exposed to annulus path 118, so when valve member 86 is spaced apart from valve seat 36 fluid can flow between annulus path 118 and tube path 120. Conversely, when valve member 86 abuts valve seat 36, the fluid path between annulus path 118 and tube path 120 is closed. Fluid pressure in annulus path 118 acts to push valve member 86 toward valve seat 36 by acting on external surface area SA4. Fluid pressure in tube path 120 acts to push valve member 86 away from valve seat 36 by acting on external surface area SA1. Control fluid pressure in chambers 62, 38 and 54 are equal and act to push valve member 86 away from valve seat 36 by acting on internal surface area SA3 and also act to push valve member 86 toward valve seat 36 by acting on internal surface area SA2. As described above, valve assembly 20 selectively defines an open position that permits flow between annulus path 118 and tube path 120 through manifold 116 and a closed position that blocks flow.

Biasing assembly 90 acts to push valve member 86 toward valve seat 36. Biasing assembly 90 can be configured for individual locations such that the force generated by biasing assembly will keep valve assembly 20 closed in all anticipated pressure conditions in either annulus path 118 and tube path 120 (including, but not limited to, pressure testing). In this configuration, valve assembly 20 is normally closed. In this configuration, opening valve assembly 20 requires application of control line pressure to chambers 38 and 54. This also requires that the effective area of internal surface area SA3 is greater than the effective area of internal surface area SA2 so that application of control line pressure to chambers 38 and 54 results in a net force pushing valve member 86 away from valve seat 36.

As shown in FIGS. 6-8, production wells can utilize several valves in several manifolds, spaced apart down the length of the production well. The force generated by biasing assembly 90 in individual valve assemblies can be altered by moving force adjusting member 94 and/or varying the number and/or type and/or orientation of biasing members 92 (such as varying the number, thickness and relative orientation of a stack of Belleville Washers). Individual valve assemblies can be configured to account for differences in relative head pressure at different depths as well as permit controlled opening and closing of individual valves using a single control line. Specifically, the valves can be configured with incrementally decreasing biasing forces, so that the required pressure applied by controller 108 to control line 102/chambers 38 and 54 to open the topmost valve opens all the valves in the string. By configuring each subsequently lower valve with an incrementally lower biasing force so the required pressure generated in control line 102 in incrementally lower, valves can be selectively closed as CNG progresses down the string by incrementally lowering the pressure generated in control line 102 by controller 108.

It has also be observed that, when starting up a gas lift assisted production well, the relative pressure of the injected CNG can be monitored to determine when a second valve opens up due to the fluid level being pushed down to uncover a lower valve. Specifically, the pressure drops. Flow rate through a single valve results in a higher back pressure than the flow rate through two valves, so when a new valve is uncovered and CNG is flowing through two valves, the relative pressure of the CNG at the well head will suddenly drop. This can be monitored at the well head and used as a trigger to incrementally reduce the pressure in control line 102 generated by controller 108. This process can then be repeated as many times as necessary to reach the bottom valve of a production well.

Figure 9:
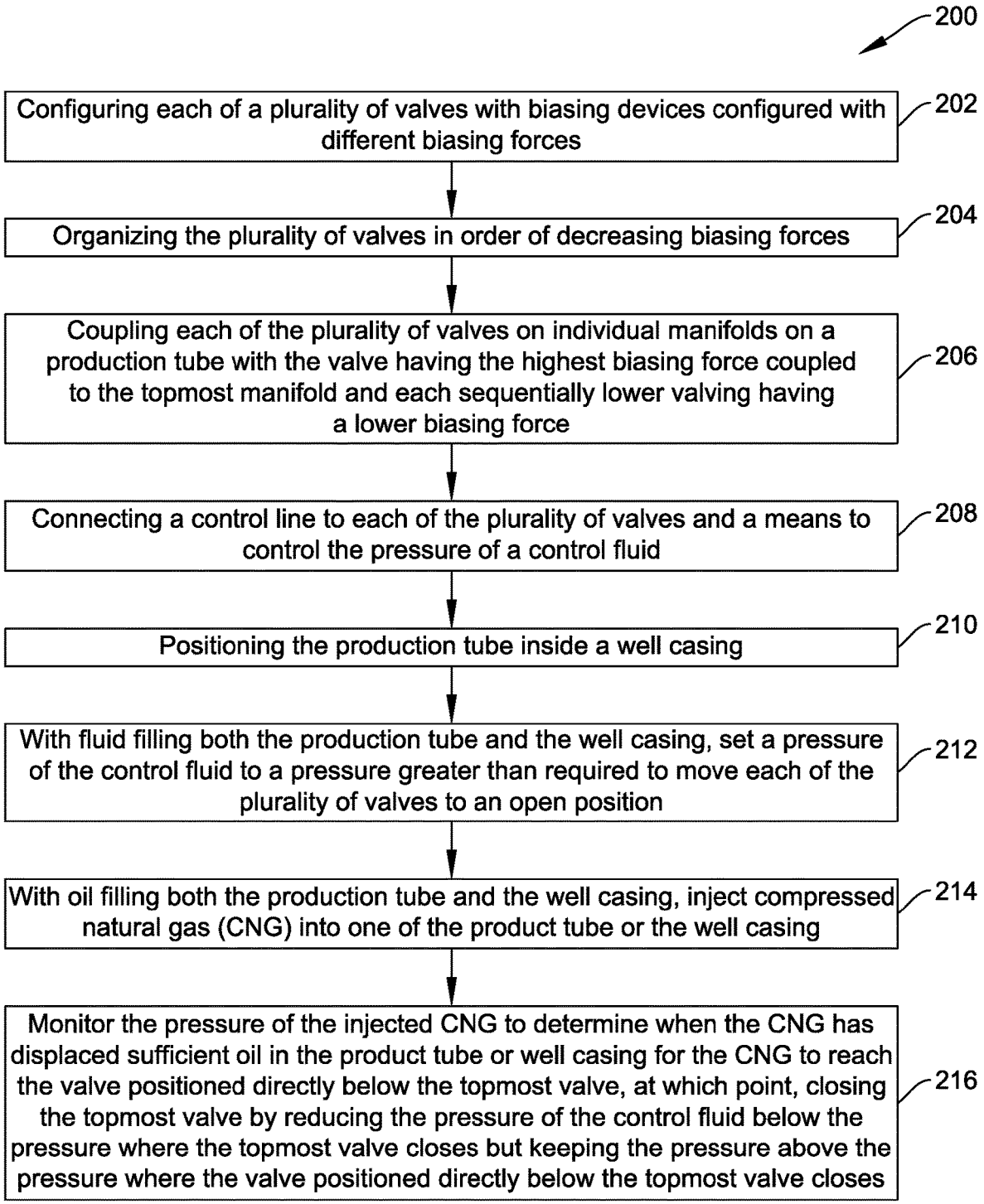
FIG. 9 is a flow chart of a method of operating a production well using the FIG. 4 valve assembly FIG. 10 are plots comparing full CNG pressure provided by the disclosed system compared to prior art systems that require dropping CNG pressure to reach production condition.

Referring to FIG. 9, process 200 is illustrated. Process 200 begins with step 202 where a plurality of valve assemblies 20 are configured with different biasing forces. In step 204, the plurality of valves are organized in order of decreasing biasing forces. In step 206, each of the plurality of valves are coupled to individual manifolds on production tube 114 with the valve having the highest biasing force coupled to valve assembly on the topmost manifolds and each sequentially lower valve having a lower biasing force. In step 208, control line 102 is connected to controller 108 and each of the valve assemblies in series. In step 210, production tube 114 is positioned inside of well casing 112. In step 212, with fluid filling both the production tube and the well casing, set a pressure of the control fluid in control line 102 using controller 108 that opens all of the connected valve assemblies 20. In step 214, inject CNG into one of tube path 120 or annulus path 118. In step 216, monitor the pressure of the injected CNG for a pressure drop indicating that a second valve has been uncovered, at which point, reduce the pressure of the control fluid in control line 102 below the pressure where the topmost valve assembly 20 closes but above the pressure to keep the valve positioned directly below the topmost valve open. Step 116 can then be repeated as necessary to uncover all the valve assemblies in a production well.

Figure 10:
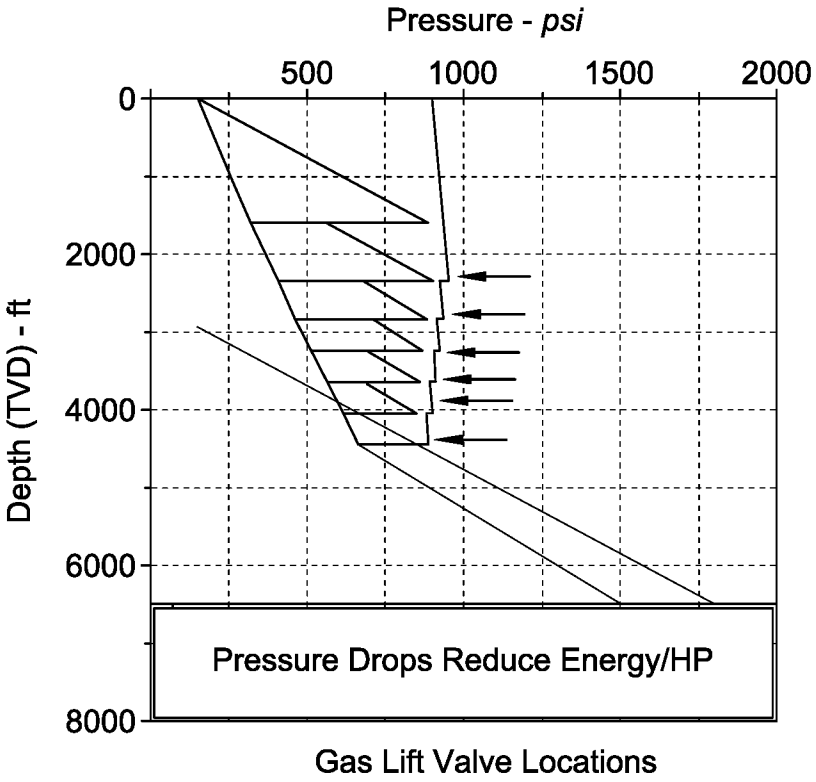
Figure 10:
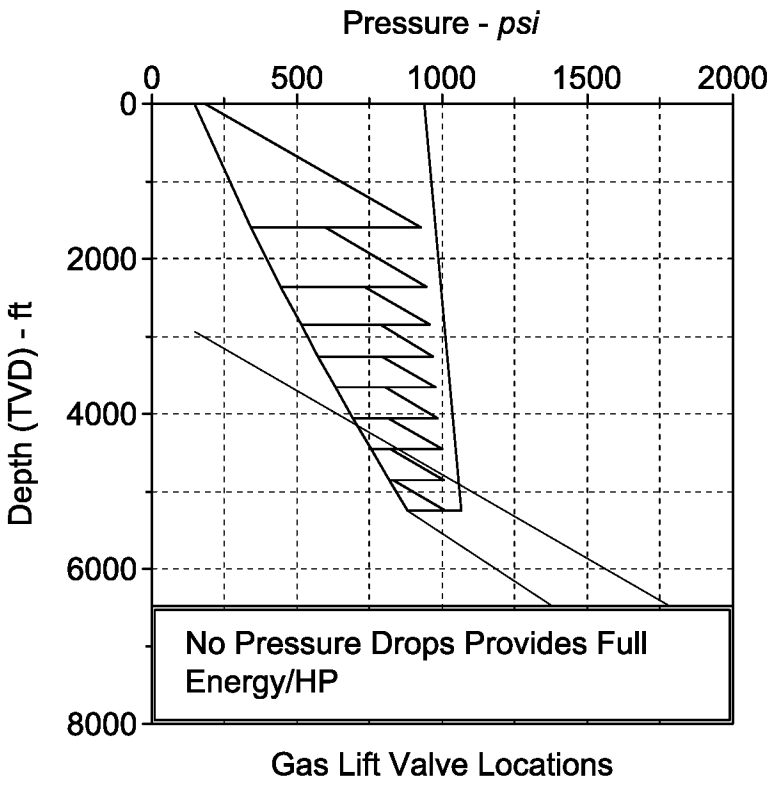

An advantage of the method disclosed in process 200 is that the pressure of the injected CNG never needs to be reduced compared to some prior art methods where the pressure of the injected CNG is used as a mechanism to control the selective closing of valves. Referring to FIG. 10, comparative plots of relative energy in different gas lift valve locations is provided comparing no pressure reduction on the left plot and pressure drops on the right plot. Reducing the pressure of the injected CNG reduces the available energy to move CNG through the fluid column at depth, which generally results in lower well output compared to being able to provide full pressure CNG at the lowest most valve, which generally results in maximizing the output of the well.

Another advantage of the valve system and method discussed above is that the valve system can be configured to operate bi-directionally, meaning that the production path could be switched between the annulus path 118 and the tube path 120 without pulling production tube 114 out of well casing 112. This could be a significant advantage in optimizing well production without the downtime normally associated with pulling and reconfiguring production tube 114.

Referring now to Tables 1 and 2 below, example configurations with tube path and annulus path production as provided. The disclosed calculations are based on a valve design with particular surface areas SA1, SA2, SA3 and SA4 and take into account head pressures for CNG, Product and Control Fluid. In addition, the number of valves and the relative depth of each valve are for example only. The purpose of Tables 1 and 2 is to demonstrate the feasibility of the disclosed control scheme. Note that the example calculations show in Table 2 indicate that different biasing forces need to be used on the lowest most valve as the indication of negative control pressure to close valves 16 and 17 indicate that it would not be possible to close valve 16 with the listed configuration. Again, these tables are provided as examples to help show how the disclosed design would operate in a potential application.

TABLE 1

Example Configuration with Tube Path Production

| Valve | Depth (ft) | CNG (psi) | Product (psi) | Biasing Force (lbs) | Control psi to open | Control psi to close |
|---|---|---|---|---|---|---|
| 1 | 2000 | 1284 | 1011 | 1100 | 5925 | 5616 |
| 2 | 2525 | 1306 | 1033 | 1050 | 5816 | 5501 |
| 3 | 3050 | 1328 | 1055 | 1000 | 5707 | 5387 |
| 4 | 3575 | 1350 | 1077 | 950 | 5598 | 5273 |
| 5 | 4100 | 1372 | 1099 | 900 | 5489 | 5159 |
| 6 | 4625 | 1394 | 1121 | 850 | 5381 | 5045 |
| 7 | 5150 | 1416 | 1143 | 800 | 5272 | 4930 |
| 8 | 5675 | 1438 | 1165 | 750 | 5163 | 4816 |
| 9 | 6200 | 1460 | 1187 | 700 | 5054 | 4702 |
| 10 | 6725 | 1482 | 1209 | 650 | 4945 | 4588 |
| 11 | 7250 | 1505 | 1232 | 600 | 4836 | 4473 |
| 12 | 7775 | 1527 | 1254 | 550 | 4727 | 4359 |
| 13 | 8300 | 1549 | 1276 | 500 | 4618 | 4245 |
| 14 | 8825 | 1571 | 1298 | 450 | 6020 | 5641 |
| 15 | 9350 | 1593 | 1320 | 400 | 4400 | 4016 |
| 16 | 9875 | 1615 | 1342 | 350 | 4291 | 3902 |
| 17 | 10400 | 1637 | 1360 | 300 | 4187 | 3792 |

TABLE 2

Example Configuration with Annulus Path Production

| Valve | Depth (ft) | CNG (psi) | Product (psi) | Biasing Force (lbs) | Control psi to open | Control psi to close |
|---|---|---|---|---|---|---|
| 1 | 2000 | 1284 | 1011 | 1100 | 5635 | 5328 |
| 2 | 2525 | 1306 | 1033 | 1050 | 5270 | 4958 |
| 3 | 3050 | 1328 | 1055 | 1000 | 4905 | 4589 |
| 4 | 3575 | 1350 | 1077 | 950 | 4540 | 4220 |
| 5 | 4100 | 1372 | 1099 | 900 | 4175 | 3850 |
| 6 | 4625 | 1394 | 1121 | 850 | 3810 | 3481 |
| 7 | 5150 | 1416 | 1143 | 800 | 3445 | 3112 |
| 8 | 5675 | 1438 | 1165 | 750 | 3079 | 2742 |
| 9 | 6200 | 1460 | 1187 | 700 | 2714 | 2373 |
| 10 | 6725 | 1482 | 1209 | 650 | 2349 | 2003 |
| 11 | 7250 | 1505 | 1232 | 600 | 1984 | 1634 |
| 12 | 7775 | 1527 | 1254 | 550 | 1619 | 1265 |
| 13 | 8300 | 1549 | 1276 | 500 | 1254 | 895 |
| 14 | 8825 | 1571 | 1298 | 450 | 889 | 526 |
| 15 | 9350 | 1593 | 1320 | 400 | 523 | 157 |
| 16 | 9875 | 1615 | 1342 | 350 | 158 | −213 |
| 17 | 10400 | 1637 | 1360 | 300 | −196 | −572 |

Figure 11:
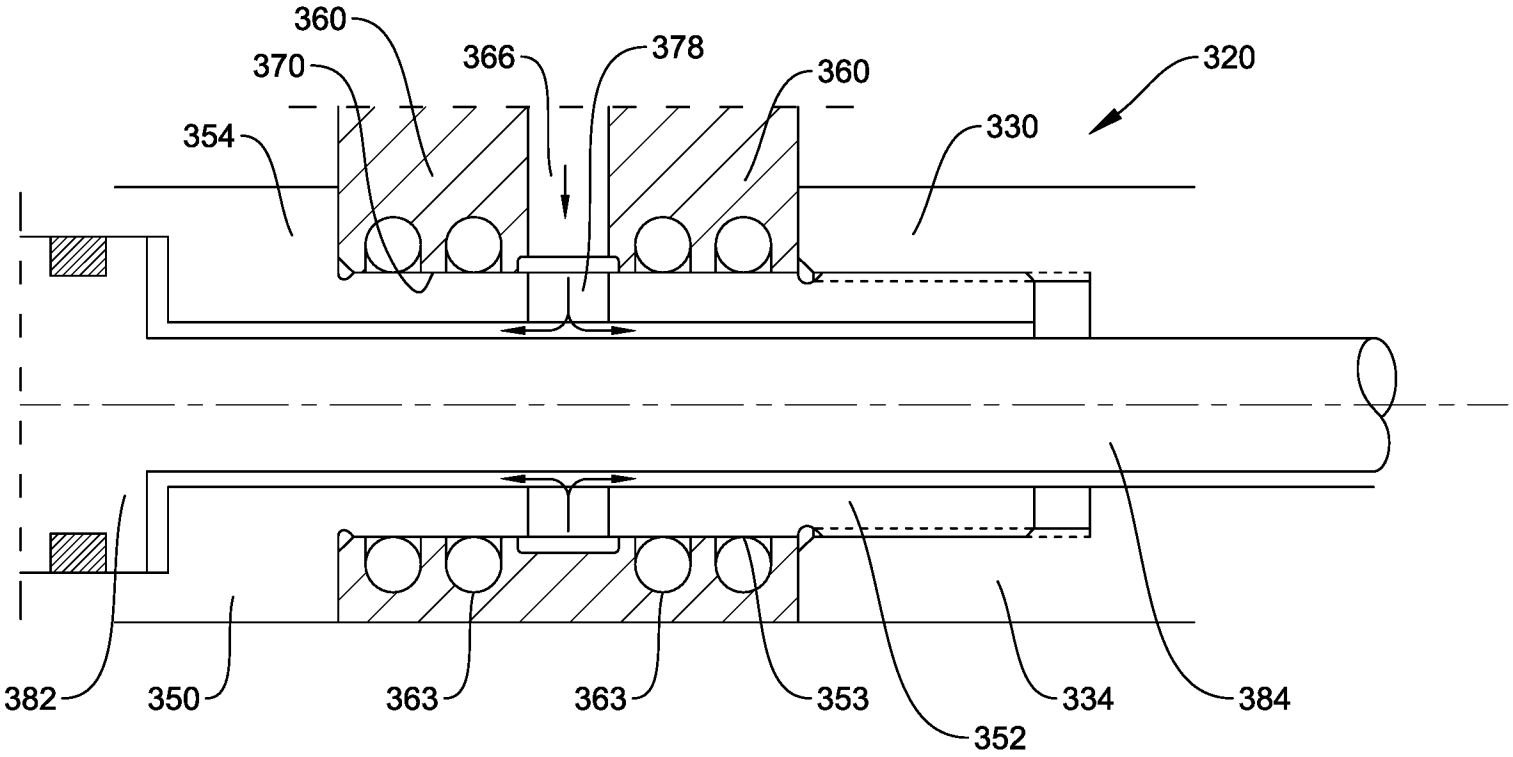
FIG. 11 is a partial cross-sectional view of an alternative embodiment of the FIG. 4 valve assembly.

Referring to FIG. 11, an alternative embodiment of valve assembly 20 is shown as valve assembly 320. Valve assembly 320 is similar to valve assembly 20, the difference primarily being in the assembly of the valve bodies with the mounting body. FIG. 11 only illustrates the relevant portion of valve assembly 320. The reset of valve assembly 320 is like valve assembly 20.

Valve assembly 320 includes valve bodies 330 and 350, mounting body 360 and stem 384. The portion of valve body 330 illustrated includes mounting portion 334. The portion of valve body 350 illustrated includes mounting portion 352, extension 353, chamber 354 and inlets 378. The portion of mounting body 360 illustrated includes seals 363, outlet 366 and mounting portion 370.

Valve assembly 320 is assembled with extension 353 passing through mounting portion 370 with mounting portion 334 attached to mounting portion 352. In the illustrated embodiment, mounting portions 334 and 352 are male and female threads that are threadingly engaged. Inlets 378 may be a plurality of orifices annularly spaced around extension 353 and configured to laterally align with outlet 366. Seals 363 are configured to seal the space between mounting portions 370 and extension 353 while permitting rotation of valve body 350 relative to mounting body 360. When mounting portions 334 and 352 are fully engaged, relative rotation between valve body 350 and mounting body 360 may be prevented, but relative rotation could be permitted by loosening the engagement between mounting portions 334 and 352. Valve assembly 320 may provide greater flexibility in rotating valve bodies 330 and 350 relative to mounting body 360 compared to valve assembly 20, which may make assembly on manifolds on production strings easier.

Figure 12:
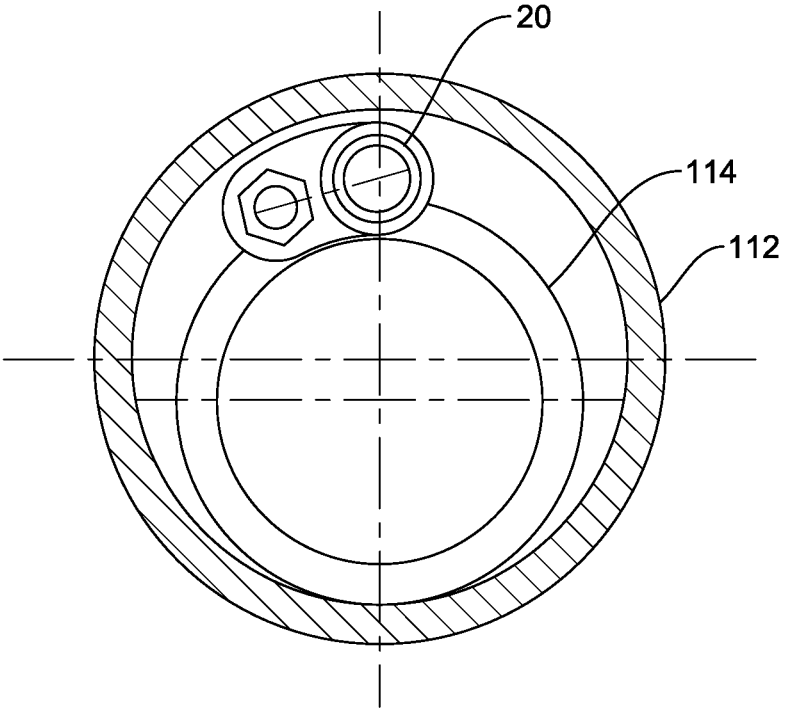
FIG. 12 is a cross-sectional view of a gas lift valve installed on a mandrel inside a well casing.
Figure 3:
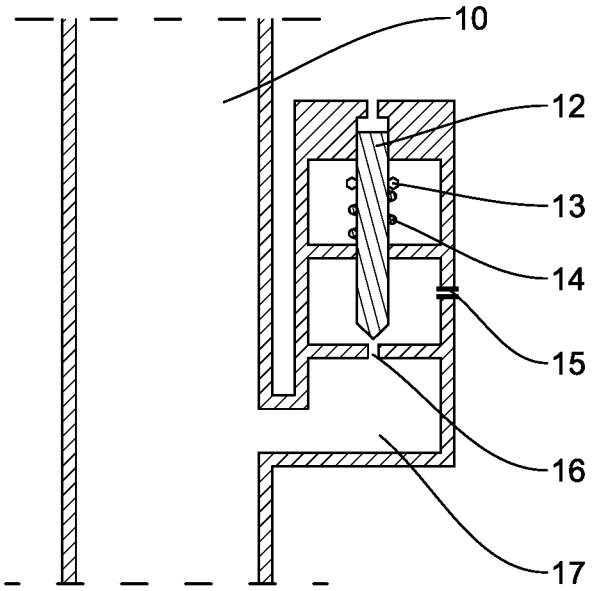
FIG. 3 (PRIOR ART)
FIG. 3 is a schematic diagram of a prior art differential valve mechanism.

Referring to FIG. 12, a cross-sectional view of a gas lift valve 20 installed on a mandrel on production tube 114 inside a well casing is shown with the tubing offset relative to the bore of well casing 112 to provide space for the gas lift valve (which is installed on one side of the tubing at a mandrel.

Figure 13:
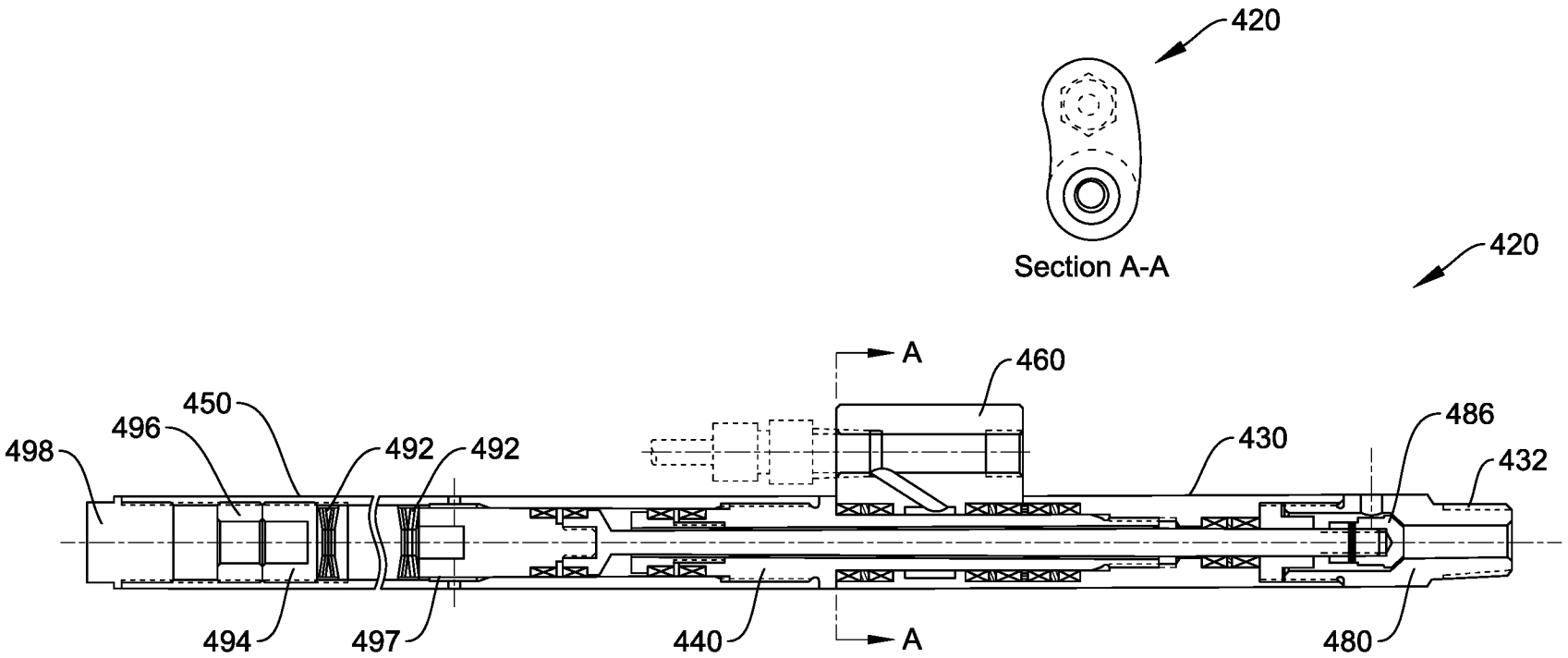
FIG. 13 is a cross-section view of an alternative embodiment of the FIG. 4 valve assembly.

Referring to FIG. 13, an alternative embodiment of valve assembly 20 is shown as valve assembly 420. Valve assembly 420 is similar to valve assembly 20, the difference primarily being in the assembly of the valve bodies with the mounting body. Valve assembly 420 generally includes lower valve body 430, upper valve body stub shaft 440, upper valve body 450, swivel body 460, and valve assembly 480. Lower valve body 430 generally includes mounting portions 432. Valve assembly 480 generally includes valve member 486. Valve assembly 420 also generally includes biasing member 492, force adjusting member 494, force locking member 496, force locking member 497 and end cap 498.

Valve assembly 420 is assembled with valve body stub shaft 440 removably coupled to both lower valve body 430 and upper valve body 450 with swivel body 460 positioned over valve body stub shaft 440 between lower valve body 430 and upper valve body 450. In the illustrated embodiment, valve bodies 430 and 450 are attached to valve body stub shaft 440 with male and female threads.

While the present disclosure has been illustrated and described in detail in the drawings and foregoing description, the same is to be considered as illustrative and not restrictive in character, it being understood that a preferred embodiment has been shown and described and that all changes, equivalents, and modifications that come within the spirit of the claimed invention defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Merriam-Webster dictionary.

The invention claimed is:

1. A remotely actuated gas lift system for lifting oil for use with a production tube positioned inside a well casing with a plurality of manifolds in the production tube spaced apart from each other along the production tube; the gas lift system comprising:

a plurality of valve assemblies configured to be mounted on the plurality of manifolds, wherein each of the plurality of valve assemblies defines an open position that permits flow between the production tube and the well casing through an individual manifold and a closed position that blocks flow between the production tube and the well casing at each individual manifold; each of the plurality of valve assemblies comprising:

a valve body containing a valve;

a coupling means for connecting the valve to one of the plurality of manifolds;

a biasing device that generates a biasing force that biases the valve towards the closed position;

a valve piston positioned within a control fluid chamber within the valve body, wherein pressurizing the control fluid chamber with a control fluid generates a force that acts against the biasing force of the biasing device;

a first inlet fluidly coupled to the control fluid chamber; and a mounting body rotatably coupled to the valve body, wherein the mounting body comprises a second inlet in fluid communication with the first inlet and wherein the valve body extends through the mounting body;

a control line containing the control fluid, wherein the control line is coupled to the control fluid chamber in each of the plurality of valve assemblies at the second inlet at each mounting body; and a means to selectively control the pressure of the control fluid in the control line;

wherein each of the individual valve assemblies is configured with biasing devices having different biasing forces in each valve, with a topmost valve having a highest biasing force and each sequentially lower valve having a lower biasing force with a lowest most valve having a lowest biasing force.

2. The system of claim 1, wherein the first inlet is rotatable relative to the second inlet.

3. The system of claim 1, wherein the biasing device is a spring.

4. The system of claim 1, wherein the biasing device comprising a Belleville washer.

5. The system of claim 1, further comprising a means to adjust the biasing force generated by the biasing device.

6. The system of claim 5, wherein the means to adjust the biasing force is a force adjusting screw.

7. The system of claim 1, wherein each of the plurality of valve assemblies is adapted to operate bi-directionally, such that compressed natural gas (CNG) can be injected into either the production tube or within the well casing outside of the production tube without reconfiguring the valve assemblies.

8. The system of claim 1, further comprising:

a pressure sensor that detects a pressure of compressed natural gas (CNG) injected into either the production tube or within the well casing outside of the production tube;

a controller that controls the means to selectively control the pressure of the control fluid in the control line, wherein the controller is programmed to incrementally lower the pressure of the control fluid based on the measured pressure of the CNG.

9. The system of claim 1, wherein each of the plurality of valve assemblies further comprises:

a valve seat;

a valve member that is movable within the valve body relative to the valve seat, wherein the position of the valve member relative to the valve seat defines an adjustable restriction to fluid flow through the valve body, wherein the biasing device pushes the valve member in a first direction that reduces fluid flow through the valve body and wherein the force generated by pressurizing the control fluid chamber with the control fluid pushes the valve member in a second direction that increases fluid flow through the valve body.

10. A method of operating the system of claim 1 comprising:

configuring each of the plurality of valve assemblies with biasing devices configured with different biasing forces;

organizing the plurality of valve assemblies in order of decreasing biasing forces;

coupling each of the plurality of valve assemblies on individual manifolds with the valve assembly having the highest biasing force coupled to the topmost manifold and each sequentially lower valve assembly having a lower biasing force;

connecting the control line to each of the plurality of valve assemblies and the means to control the pressure of the control fluid;

positioning the production tube inside the well casing;

with liquid filling both the production tube and the well casing, set the pressure of the control fluid to a pressure greater than required to move each of the plurality of valve assemblies to the open position;

with liquid filling both the production tube and the well casing, inject compressed natural gas (CNG) into one of the production tube or the well casing;

determining when the CNG has displaced sufficient liquid in the production tube or well casing for the CNG to reach the valve assembly positioned directly below the topmost valve assembly at which point closing the topmost valve by reducing the pressure of the control fluid below the pressure where the topmost valve assembly closes but keeping the pressure above the pressure where the valve assembly positioned directly below the topmost valve assembly opens.

11. The system of claim 1, wherein the mounting body defines a fluid path between adjacent valves that does not include the valve that passes through the mounting body.

12. A valve for use in a remotely actuated gas lift system for use with a production tube positioned inside a well casing with a plurality of manifolds in the production tube spaced apart from each other along the production tube, wherein the valve is controlled using a control line positioned inside the well casing, wherein the control line caries a control fluid; the valve comprising:

a valve body defining a first inlet;

a valve seat;

a valve member that is movable within the valve body relative to the valve seat, wherein the position of the valve member relative to the valve seat defines an adjustable restriction to fluid flow through the valve body;

a mounting body rotatably coupled to the valve body, wherein the mounting body defines a second inlet in fluid communication with the first inlet and wherein the valve body extends through the mounting body and wherein the second inlet is adapted to fluidly couple to the control line;

a coupling means for connecting the valve body to one of the plurality of manifolds;

a biasing device that generates a biasing force that pushes the valve member in a first direction that reduces fluid flow through the valve body; and a valve piston positioned within a control fluid chamber within the valve, wherein the control fluid chamber is in fluid communication with the first inlet, and wherein increasing pressure of a control fluid in the control fluid chamber pushes the valve member in a second direction that increases fluid flow through the valve body.

13. The valve of claim 12, wherein the first inlet is rotatable relative to the second inlet.

14. The valve of claim 12, wherein the mounting body further comprises an outlet adapted to couple the control line to another valve.

15. The valve of claim 14, wherein the outlet is rotatable relative to the valve body.

16. The valve of claim 12, wherein the valve is adapted to operate bi-directionally, such that compressed natural gas (CNG) can be injected into either the production tube or within the well casing outside of the production tube without reconfiguring the valve.

17. A method of operating a remotely actuated gas lift system using the valve of claim 12, the method comprising:

providing a plurality of valves of the valve of claim 12;

coupling each of the plurality of valves on individual manifolds connecting the control line to each of the plurality of valves and a means to control the pressure of the control fluid;

positioning the production tube inside the well casing;

with liquid filling both the production tube and the well casing, setting the pressure of the control fluid to a pressure greater than required to move each of the plurality of valves to the open position;

with liquid filling both the production tube and the well casing, inject compressed natural gas (CNG) into one of the production tube or the well casing;

determining when the CNG has displaced sufficient liquid in the production tube or well casing for the CNG to reach the valve positioned directly below the topmost valve at which point closing the topmost valve by reducing the pressure of the control fluid below the pressure where the topmost valve closes but keeping the pressure above the pressure where the valve positioned directly below the topmost valve closes.

18. A method for operating a gas lift system for lifting oil for use with a production tube positioned inside a well casing with a plurality of manifolds in the production tube space apart along the production tube, the method comprising:

coupling a valve to each of the plurality of manifolds, wherein each valve comprises:

a valve body that contains the valve;

a mounting body rotatably coupled to the valve body, wherein the valve body extends through the mounting body;

a member that is movable within the valve relative to a seat, wherein the position of the member defines an adjustable restriction to fluid flow through the valve;

a biasing device that pushes the member in a first direction that reduces fluid flow through the valve;

a pressure chamber and a piston, wherein pressure in the pressure chamber pushes the piston and the member in a second direction opposite the first direction which increases fluid flow through the valve, wherein, absent sufficient pressure in the pressure chamber, the biasing device closes the valve;

coupling a pressure control device to each of the pressure chambers through each of the mounting bodies with a single control line;

positioning the production tube inside the well casing;

with oil filling both the production tube and the well casing, setting the pressure produced by the pressure control device to a pressure greater than required to open each of the valves;

with oil filing both the production tube and the well casing, inject compressed natural gas (CNG) into one of the production tube or the well casing;

determining when the CNG has displaced sufficient oil in the production tube or well casing for the CNG to reach the valve positioned directly below the topmost valve at which point closing the topmost valve by reducing the pressure of the control fluid below a first pressure where the topmost valve closes but keeping the pressure above a second pressure where the valve positioned directly below the topmost valve remains open.

19. A valve for use in a remotely actuated gas lift system for use with a production tube positioned inside a well casing with a plurality of manifolds in the production tube spaced apart from each other along the production tube, wherein the valve is controlled using a control line positioned inside the well casing, wherein the control line caries a control fluid; the valve comprising:

a valve body;

a mounting body rotatably coupled to the valve body, wherein the valve body extends through the mounting body, wherein the mounting body is adapted to couple to the control line;

a valve seat;

a valve member that is movable within the valve body relative to the valve seat, wherein the position of the valve member relative to the valve seat defines an adjustable restriction to fluid flow through the valve body;

a coupling means for connecting the valve body to one of the plurality of manifolds;

a valve piston positioned within a control fluid chamber within the valve, wherein changing pressure of a control fluid in the control fluid chamber moves the valve member relative to the valve seat; and a first inlet for fluidly coupling the control line to the mounting body;

a second inlet to the control fluid chamber, wherein the second inlet is in fluid communication with the first inlet and wherein the second inlet is rotatable relative to the first inlet.

20. The valve of claim 19, further comprising an outlet in the mounting body for fluidly coupling the control line to another valve.

21. The valve of claim 20, wherein the mounting body defines a fluid path between adjacent valves that does not include the valve that passes through the mounting body.

* * * * *